US005902419A

United States Patent [19]

Fujita et al.

[11] Patent Number: 5,902,419

[45] Date of Patent: May 11, 1999

[54] SILICON STEEL SHEET AND METHOD THEREOF

[75] Inventors: Koichiro Fujita; Yasushi Tanaka; Hironori Ninomiya; Tatsuhiko Hiratani; Shoji Kasai, all of Tokyo, Japan

[73] Assignee: NKK Corporation, Tokyo, Japan

[21] Appl. No.: 08/717,623

[22] Filed: Sep. 23, 1996

[30] Foreign Application Priority Data

| | | | |
|---|---|---|---|
| Oct. 6, 1995 | [JP] | Japan | 7-260042 |
| Feb. 27, 1996 | [JP] | Japan | 8-039705 |
| Jun. 26, 1996 | [JP] | Japan | 8-165820 |

[51] Int. Cl.[6] ..... H01F 1/14

[52] U.S. Cl. ..... 148/307; 148/113; 420/117

[58] Field of Search ..... 148/307, 308, 148/111, 112, 110, 113; 420/117

[56] References Cited

U.S. PATENT DOCUMENTS

| | | | |
|---|---|---|---|
| 4,824,493 | 4/1989 | Yoshitomi et al. | 148/111 |
| 4,832,762 | 5/1989 | Nakaoka et al. | 148/108 |
| 5,078,808 | 1/1992 | Schoen | 148/111 |
| 5,089,061 | 2/1992 | Abe et al. | 148/110 |
| 5,139,582 | 8/1992 | Kurosawa et al. | 148/111 |
| 5,173,128 | 12/1992 | Komatsubara et al. | 148/111 |
| 5,200,145 | 4/1993 | Krutenat et al. | 148/113 |
| 5,244,511 | 9/1993 | Komatsubara et al. | 148/111 |

FOREIGN PATENT DOCUMENTS

| | | |
|---|---|---|
| 0 234 443 | 9/1987 | European Pat. Off. . |
| 0 468 819 | 1/1992 | European Pat. Off. . |
| 61-149432 | 7/1986 | Japan . |
| 62-227078 | 10/1987 | Japan . |
| 62-227079 | 10/1987 | Japan . |
| 5-125496 | 5/1993 | Japan . |
| 5-186825 | 7/1993 | Japan . |
| 6-145799 | 5/1994 | Japan . |
| 6-212397 | 8/1994 | Japan . |

OTHER PUBLICATIONS

Patent Abstracts of Japan, vol. 017, No. 492 (C–1107), Sep. 7, 1993 of JP–A–05 125496 (NKK Corp), May 21, 1993.

Patent Abstracts of Japan, vol. 017, No. 617 (C–1129), Nov. 15, 1993 of JP–A–05 186825 (Sumitomo Metal Ind Ltd), Jul. 27, 1993.

Patent Abstracts of Japan, vol. 010, No. 350 (C–387), Nov. 26, 1986 of JP–A–61 149432 (Kawasaki Steel Corp), Jul. 8, 1986.

Patent Abstracts of Japan, vol. 017, No. 647 (C–1135), Dec. 1993 of JP–A–05 207817 (Tsurumi Soda KK), Aug. 1993.

Patent Abstracts of Japan, vol. 018, No. 468 (C–1244), Aug. 31, 1994 of JP–A–06 145799 (Kawasaki Steel Corp), May 27, 1994.

Patent Abstracts of Japan, vol. 018, No. 578 (C–1269), Nov. 7, 1994 of JP–A–06 212397 (NKK Corp), Aug. 2, 1994.

*Primary Examiner*—John Sheehan

*Attorney, Agent, or Firm*—Frishauf, Holtz, Goodman, Langer & Chick, P.C.

[57] ABSTRACT

A silicon steel sheet contains 0.01 wt. % or less C, 4 to 10 wt. % Si, 0.5 wt. % or less Mn, 0.01 wt. % or less P, 0.01 wt. % or less S, 0.2 wt. % or less sol. Al, 0.01 wt. % or less N, 0.02 wt. % or less 0 and the balance being Fe. The silicon steel sheet has grain boundaries and carbides which are precipitated on the grain boundaries. The carbides have an area of 20% or less to an area of the grain boundaries. The steel sheet is cooled at a cooling speed of 5° C./sec. or more in a temperature range of from 300 to 700° C.

11 Claims, 6 Drawing Sheets

SILICON STEEL SHEET AND METHOD THEREOF

BACKGROUND OF THE INVENTION

1. Field of the Invention

The present invention relates to a high silicon steel and a method thereof.

2. Description of the Related Arts

Soft magnetic properties of silicon steel sheets which are used as a core material of electromagnetic induction equipment are improved with the increase of the added amount of Si. It is known to give maximum magnetic permeability of the silicon steel sheet at around 6.5 wt. % of Si content. If, however, the Si content increases to 4 wt. % or more, the workability of the steel sheet rapidly deteriorates. Therefore, it was accepted that the ordinary rolling method cannot produce high silicon steel sheet on a commercial scale.

As a method for commercially manufacturing high silicon steel sheet containing 4 wt. % or more Si by solving the above-described problem on workability, the siliconizing method is disclosed in Japanese unexamined patent publication No. 62-227078. The siliconizing method comprises the steps of: reacting a thin steel sheet containing less than 4 wt. % Si with $SiCl_4$ at an elevated temperature to penetrate Si into the steel sheet; and diffusing the penetrated Si in the sheet thickness direction, thereby to produce a high silicon steel sheet. For example, Japanese unexamined patent publication No.62-227078 and Japanese unexamined patent publication No. 62-227079 subject a steel sheet to continuous siliconizing treatment in a non-oxidizing gas atmosphere containing 5 to 35 wt. % $SiCl_4$ at a temperature of from 1023 to 1200° C., thus obtaining a coiled high silicon steel sheet.

Generally, the siliconizing treatment uses $SiCl_4$ as the raw material gas to supply Si. The $SiCl_4$ reacts with the steel sheet in accordance with the reaction equation given below. Si penetrates into the surface layer of the silicon steel sheet.

$$SiCl_4+5Fe \rightarrow Fe_3Si+2FeCl_2$$

The Si thus penetrated into the surface layer of the steel sheet diffuses in the sheet thickness direction by soaking the steel sheet in a nonoxidizing gas atmosphere containing no $SiCl_4$.

A continuous siliconizing line for continuously siliconizing a steel sheet by the process described above has heating zone, siliconizing zone, diffusing and soaking zone, and cooling zone, from inlet to exit thereof. That is, the steel sheet is continuously heated in the heating zone up to the treatment temperature, and the steel sheet is reacted with $SiCl_4$ in the siliconizing zone to let Si penetrate into the steel, then the steel sheet is continuously heat-treated in the diffusing and soaking zone to diffuse Si in the sheet thickness direction, and the steel sheet is cooled in the cooling zone to obtain a coiled high silicon steel sheet.

Conventional continuous annealing line maintains the oxygen concentration and dew point in the annealing furnace at a constant level to suppress the oxidization on the surface of steel sheet. As to the intrafurnace atmosphere of a continuous siliconizing line, Japanese unexamined patent publication No.6-212397 points out a problem that the oxidization occurs at surface and at grain boundary of the steel sheet and bending workability of product is deteriorated when the steel is subjected to siliconizing and diffusion treatment in an atmosphere having a water vapor concentration corresponding to dew point of −30° C. or more. Therefore, the patent publication proposes a method for continuously manufacturing high silicon steel sheet having excellent bending and punching workability wherein the oxidization at surface and grain boundary of the steel sheet is restrained and products having favorable workability are manufactured. According to the method, the intrafurnace atmosphere is controlled so as to satisfy the following conditions:

oxygen concentration; 45 ppm or less, dew point; −30° C. or less, $[O_2]$, $[H_2O]$; $[H_2O]^{1/4}\times[O_2]<80$, wherein $[O_2]$ is oxygen concentration expressed by ppm and $[H_2O]$ is water vapor concentration expressed by ppm.

A method for controlling the intrafurnace atmosphere to establish the above-described conditions is the method using the strong reducing power of carbon. The continuous siliconizing line is held at 1023° C. or more to carry out the penetration and diffusion of Si. When carbon exists in the steel sheet within the temperature range, the oxygen and water vapor in the furnace react with the carbon to form CO, thus enabling the control of intrafurnace atmosphere that was proposed by unexamined Japanese patent publication No. 6-212397.

When, however, that type of method was applied to control the intrafurnace atmosphere to manufacture high silicon steel sheets, the workability of products was found to be deteriorated even when the oxidization at surface and grain boundary of the steel was suppressed.

On the other hand, as described before, it was accepted that a high silicon steel sheet containing 4 wt. % or more Si cannot be produced by rolling method. However, Japanese unexamined patent publication No. 63-35744, for example, proposed to roll a steel sheet under the control of rolling temperature and rolling reduction. That type of technology enables to conduct rolling.

To use a high silicon steel sheet practically as a core material for electromagnetic induction equipment, however, a secondary working such as punching, bending, shearing is required to apply to the steel sheet. Thus, there is a problem that, even if a high silicon steel sheet is manufactured by the rolling method through the control of rolling temperature and rolling reduction, the steel sheet cannot be worked to form a core for electromagnetic induction equipment owing to the poor secondary workability.

SUMMARY OF THE INVENTION

It is an object of the present invention to provide a high silicon steel sheet having excellent workability and a method therefor.

To achieve the object, first, the present invention provides a silicon steel sheet consisting essentially of:

C in an amount of 0.01 wt. % or less, Si in an amount of 4 to 10 wt. % and the balance being Fe;

said silicon steel sheet having grain boundaries and carbides which are precipitated on the grain boundaries;

said carbides having an area of 20% or less to an area of the grain boundaries.

Secondly, the present invention provides a silicon steel sheet consisting essentially of:

C in an amount of 0.01 wt. % or less, Si in an amount of 4 to 10 wt. %, Mn in an amount of 0.5 wt. % or less, P in an amount of 0.01 wt. % or less, S in an amount of 0.01 wt. % or less, sol. Al in an amount of 0.2 wt. % or less, N in an amount of 0.01 wt. % or less, O in an amount of 0.02 wt. % or less and the balance being Fe;

said silicon steel sheet having grain boundaries and carbides which are precipitated on the grain boundaries;

said carbides having an area of 20% or less to an area of the grain boundaries.

Thirdly, the present invention provides a method for producing a silicon steel sheet comprising the steps of:

preparing a steel sheet containing Si in an amount of less than 4 wt. %;

siliconizing the steel sheet in a non-oxidizing gas atmosphere containing $SiCl_4$ to produce a steel sheet containing Si in an amount of from 4 to 10 wt. %;

heat treating the siliconized steel sheet in a non-oxidizing gas atmosphere containing no $SiCl_4$ to diffuse Si into an internal portion of the steel sheet;

cooling the heat treated steel sheet at a cooling speed of 5° C./sec. or more in a temperature range of from 300 to 700° C., thereby to produce a silicon steel sheet having grain boundaries and carbides which are precipitated on the grain boundaries and have an area of 20% or less to an area of the grain boundaries.

Fourthly, the present invention provides a method for producing a silicon steel sheet comprising the steps of:

preparing a steel slab containing C in an amount of 0.01 wt. % or less and Si in an amount of from 4 to 10 wt. %;

hot rolling the steel slab to produce a hot rolled steel sheet;

descaling the hot rolled steel sheet;

cold rolling the descaled hot rolled steel sheet to produce a cold rolled steel sheet; and subjecting a final annealing treatment having a cooling speed of 5° C./sec. or more in a temperature range of from 300 to 700° C. to the cold rolled steel sheet at a temperature of at least 700° C., thereby to produce a silicon steel sheet having grain boundaries and carbides which are precipitated on the grain boundaries and have an area of 20% or less to an area of the grain boundaries.

Fifthly, the present invention provides a method for producing a silicon steel sheet comprising the steps of:

preparing a steel sheet containing Si in an amount of less than 4 wt. % and C in an amount of 0.0065 wt. % or less;

siliconizing the steel sheet in a non-oxidizing gas atmosphere containing $SiCl_4$ to produce a steel sheet containing Si in an amount of from 4 to 10 wt. %;

heat treating the siliconized steel sheet in a non-oxidizing gas atmosphere containing no $SiCl_4$ to diffuse Si into an internal portion of the steel sheet;

cooling the heat treated steel sheet at a cooling speed of 1° C./sec. or more, thereby to produce a silicon steel sheet having grain boundaries and carbides which are precipitated on the grain boundaries and have an area of 20% or less to an area of the grain boundaries.

DESCRIPTION OF THE EMBODIMENT

Figure 1:
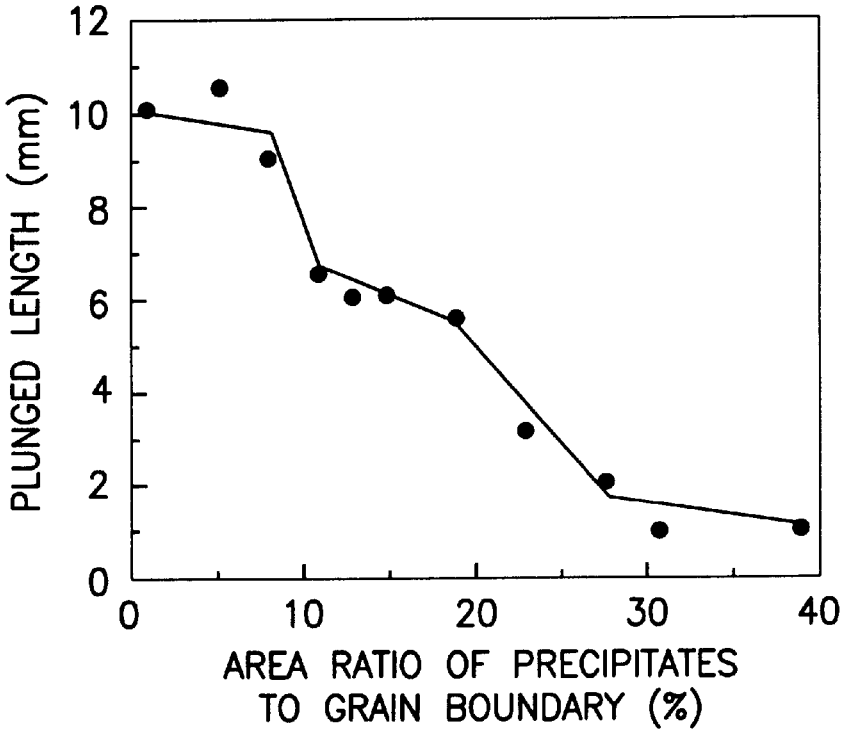
FIG. 1 is a graph showing the relation between the area ratio of precipitates to grain boundary and the plunged length determined in a three-point bending test for a high silicon steel sheet having 0.3 mm of thickness, which sheet was prepared by the siliconizing method.

Inventors of the present invention made detail investigation on the causes of the deteriorated workability, and found that carbide is selectively formed at grain boundary to act as the starting point of the fracture. The mechanism of the generation of the phenomenon is assumed as follows.

For the case of siliconizing method, the steel sheet is heat treated at an elevated temperature to 1023° C. or more, so the existed strain is removed, and the area of grain boundary decreases owing to the growth of crystal grains. Accordingly, carbon likely to gather at grain boundary during the cooling step, and carbide selectively generates at grain boundary during the step of further cooling of the steel sheet. Since high silicon steel sheet is a material of considerably brittle, the carbide at grain boundary becomes the starting point of fracture, which deteriorates the workability of product.

The rolling method employs the final annealing after rolling the steel sheet to a specified thickness to improve the soft magnetic properties. However, the steel sheet induces recrystallization and gives growth of crystal grains during the final annealing step, so the area of grain boundary decreases. As a result, carbon likely gathers at grain boundary during the cooling step, thus carbide selectively generates at grain boundary during the step of further cooling of the steel sheet.

Since high silicon steel sheet is a material of significantly brittle, the carbide at grain boundary becomes the starting point of fracture, thus deteriorating the workability of product.

The inventors focused on the point and performed investigation, and found that the workability does not deteriorate if only the area of carbide precipitated at grain boundary is 20% or less to the total area of grain boundary.

Furthermore, the inventors found that, to suppress the generation of carbide at grain boundary, it is effective in the siliconizing method to control the cooling speed of the steel sheet in the cooling zone, and it is effective in the rolling method to control the cooling speed in the final annealing zone, thus enabling the stable manufacture of high workability high silicon steel sheet.

The present invention was completed on the basis of the findings described above.

According to the present invention, the high silicon steel sheet contains 0.01 wt. % or less C and 4 to 10 wt. % Si, and has 20% or less area of carbide precipitated on grain boundary to the total area of grain boundary. The high silicon steel sheet may contain 0.01 wt. % or less C, 4 to 10 wt. % Si, 0.5 wt. % or less Mn, 0.01 wt. % or less P, 0.01 wt. % or less S, 0.2 wt. % or less sol.Al, 0.10 wt. % or less N, and 0.02 wt. % or less O. A more preferable range of the area of carbide precipitated on grain boundary is 10% or less to the total area of grain boundary.

The following is the description of reasons for specifying the content of individual components.

Carbon is a harmful element against soft magnetic properties. In particular, the C content of more than 0.01 wt. % deteriorates the soft magnetic properties owing to an aging phenomenon. Also from the point of workability, when the C content exceeds 0.01 wt. %, carbide which gives bad influence to workability is easily formed by precipitation. Accordingly, the C content is specified to 0.01 wt. % or less.

Silicon is an element to generate soft magnetic properties, and the best magnetic properties appear at about 6.5 wt. % of Si content. Si content of less than 4 wt. % cannot give favorable magnetic properties as high silicon steel sheet. At below 4 wt. % of Si content, the steel sheet provides favorable workability so that there is no need to apply the present invention for that kind of steel sheet. On the other hand, if the Si content exceeds 10 wt. %, the saturation magnetic flux density significantly reduces. Consequently, the Si content is specified to a range of from 4 to 10 wt. %. When the rolling method is applied to manufacture the product, however, the manufacturing of steel sheet becomes difficult at above 7 wt. % Si content, so the upper limit in that case substantially becomes 7 wt. %.

Manganese combines with S to form MnS, thus improving the hot workability at the slab-forming stage. if, however, the Mn content exceeds 0.5 wt. %, the reduction of saturation magnetic flux density becomes significant. Therefore, the Mn content is preferably 0.5 wt. % or less.

Phosphorus is an element to deteriorate soft magnetic properties, and the content is preferred to decrease as far as possible. Since the P content of 0.01 wt. % or less raises substantially no bad influence and is preferred from economy, it is preferable that the P content is specified as 0.01 wt. % or less.

Sulfur is an element to deteriorate hot workability and also to deteriorate soft magnetic property. Accordingly, the S content is preferably low as far as possible. Since the S content of 0.01 wt. % or less raises substantially no bad influence and is preferred from economy, the S content of 0.01 wt. % or less is preferable.

Aluminum has an ability to clean steel by deoxidization and, from a view point of the soft magnetic property, has a function to increase the electric resistance. For a steel which contains 4 to 10 wt. % Si as in the case of the present invention, Si addition improves the soft magnetic properties, and Al is expected only to function the deoxidization of the steel. Accordingly, it is preferable that the content of sol. Al is specified as 0.2 wt. % or less Since N is an element to deteriorate soft magnetic properties and also to induce deterioration of magnetic properties owing to aging, the N content is preferably as low as possible. Since the N content of 0.01 wt. % or less raises substantially no bad influence and is preferred from the economy, the N content of 0.01 wt. % or less is preferable.

Oxygen is an element to deteriorate soft magnetic properties and gives bad influence to workability. So the O content is preferably as low as possible. From the point of economy, the O content of 0.02 wt. % or less is preferable.

The following is the description about the precipitates formed at grain boundary.

The precipitates formed at grain boundary are observed by applying weak etching on the buffed steel sheet. The inventors studied the precipitates in detail using a transmission electron microscope, and found that the precipitates are carbide of Fe or of Fe and Si and that the precipitates are produced at a temperature of about 700° C. or less. As described above, the amount of carbide precipitates produced at grain boundary has a strong significance on the workability of the steel sheet.

The significant relationship is explained based on FIG. 1 which was prepared using a high silicon steel sheet manufactured by the siliconizing method. FIG. 1 is a graph showing the relation between the area ratio of carbide at grain boundary to the total area of grain boundary and the plunged length determined in the three-point bending test.

Figure 2:
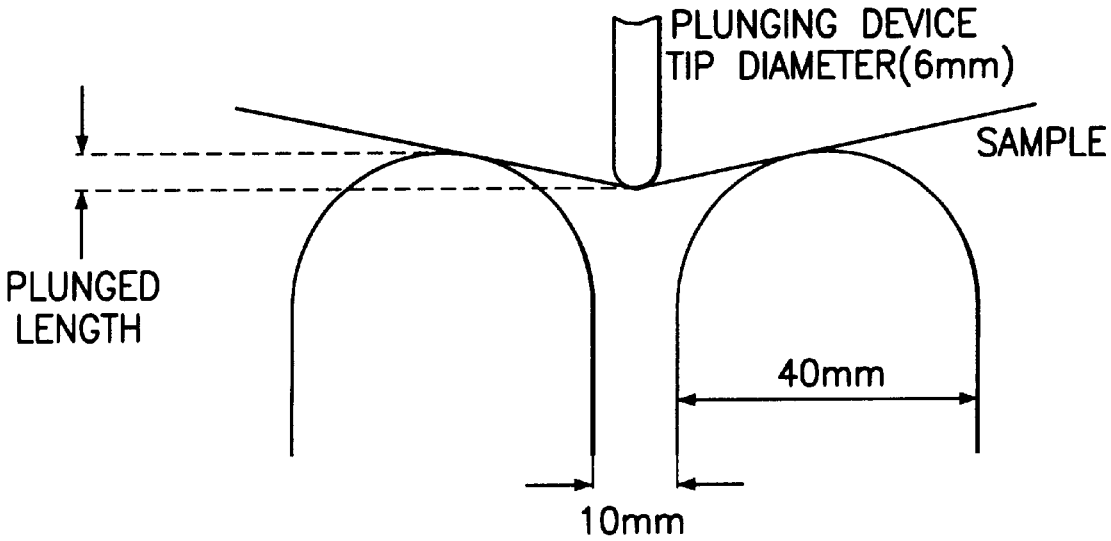
FIG. 2 illustrates the three-point bending test for evaluating the workability of steel sheet.

The applied samples of high silicon steel sheet prepared by the siliconizing method were produced by the following procedure. A steel containing 3 wt. % Si was melted and was hot-rolled and cold-rolled to produce a steel sheet having a sheet thickness of 0.3 mm. The steel sheet was siliconized in a conventional continuous siliconizing line to obtain the high silicon steel sheet containing about 6.5 wt. % Si. The composition of the obtained high silicon steel sheet is shown in Table 1. Siliconizing treatment reduced the content of C and Mn to some extent, and Table 1 shows the composition after the siliconizing treatment. During the siliconizing treatment, samples having different conditions of precipitation of carbide were prepared by changing the cooling speed of the steel sheet. The horizontal axis of FIG. 1 is the "ratio of precipitates to grain boundary", and the ratio was determined by the steps of: polishing the cross section of each sample; etching selectively the carbide using a Picral acid solution; taking photographs of the etched section at a magnitude of 400; determining the total grain boundary length from the photograph; determining, on the other hand, the total length of carbide precipitated at grain boundary; and computing the ratio of carbide to the total grain boundary from these values. The vertical axis of FIG. 1 shows the plunged length determined in a three-point bending test using a testing machine shown in FIG. 2. In the test with the testing machine of FIG. 2, the plunging device pressed the sample at a plunging speed of 2 mm/min. The bending workability was evaluated by the plunged length at the point of fracture.

As seen in FIG. 1, smaller amount of carbide at grain boundary gives better bending workability. When the plunged length in the three-point bending test exceeds 5 mm, the bending workability is accepted as superior to that in conventional material. Thus, FIG. 1 suggests that, to attain a plunged length of above 5 mm, a favorable area ratio of precipitates to the total area of grain boundary is 20% or less. Also the result given in FIG. 1 shows that better workability is attained by making the area ratio of carbide at grain boundary against the total area of grain boundary to 10% or less.

TABLE 1

| (wt %) | | | | | | | |
|---|---|---|---|---|---|---|---|
| C | Si | Mn | P | S | sol.Al | N | O |
| 0.0071 | 6.42 | 0.24 | 0.007 | 0.004 | 0.11 | 0.002 | 0.011 |

The condition is similar with that for a high silicon steel sheet which is manufactured by the rolling method. Accordingly, the amount of carbide precipitated at grain boundary has very strong correlation with the secondary workability of the steel sheet.

Figure 3:
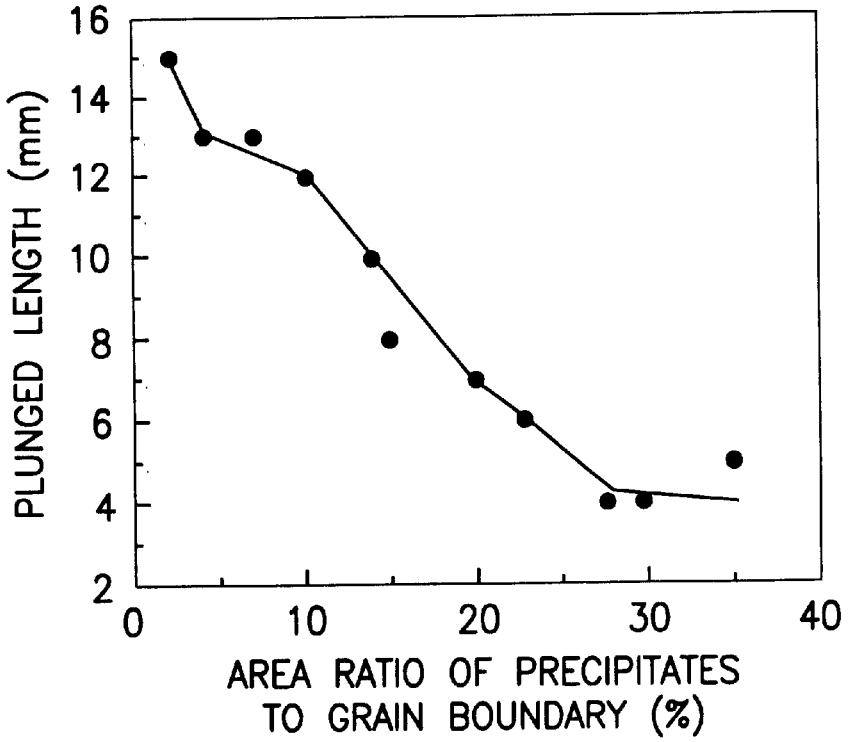
FIG. 3 is a graph showing the relation between the area ratio of precipitates to grain boundary and the plunged length determined in the three-point bending test for the high silicon steel sheet having 0.2 mm of thickness, which sheet was prepared by the rolling method.
Figure 4:
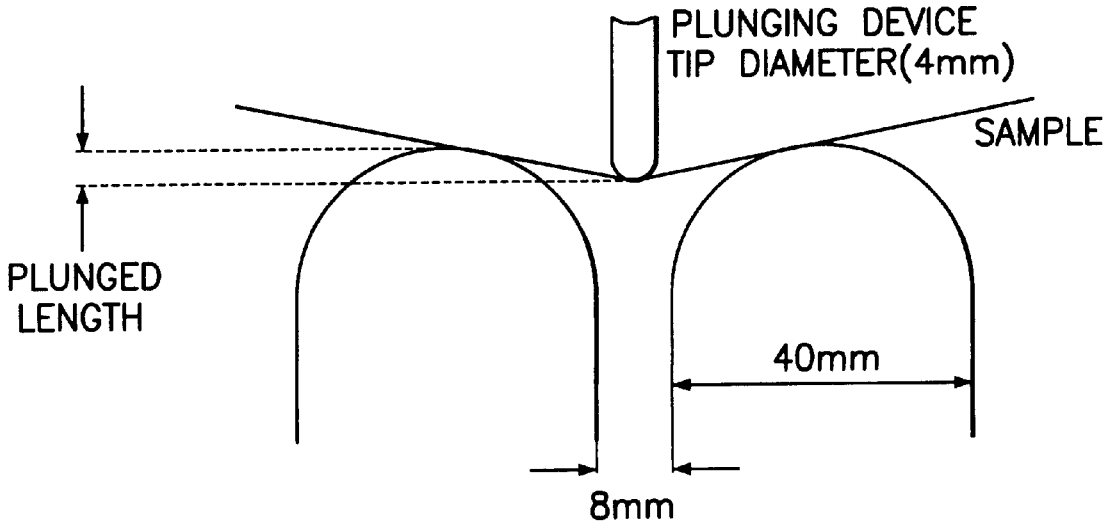
FIG. 4 illustrates the three-point bending test for evaluating the workability of steel sheet.

FIG. 3 shows a confirmation result on the relation observed on a high silicon steel sheet prepared by the rolling method. FIG. 3 is a graph showing the relation between the area ratio of carbide at grain boundary to the total area of grain boundary and the plunged length determined in the three-point bending test, similar with that in FIG. 2. The tested high silicon steel sheet had 0.2 mm of thickness and had the chemical composition given in Table 2, which sheet was prepared by the rolling method. Accordingly, the vertical axis and the horizontal axis in FIG. 3 are the same as in FIG. 2. The "ratio of precipitates to grain boundary" in the figure was determined by the same procedure applied in FIG. 1. The "plunged length" is the plunged length determined in the three-point test conducted by the testing machine shown in FIG. 4. In the test with the testing machine of FIG. 4, the plunging device pressed the sample at a plunging speed of 3 mm/min. The bending workability was evaluated by the plunged length at the point of fracture. As seen in FIG. 3, smaller amount of carbide at grain boundary gives better bending workability.

TABLE 2

| (wt %) | | | | | | | |
|---|---|---|---|---|---|---|---|
| C | Si | Mn | P | S | sol.Al | N | O |
| 0.0060 | 6.55 | 0.24 | 0.005 | 0.003 | 0.12 | 0.001 | 0.006 |

The following is the description of the method for manufacturing a high silicon steel sheet according to the present invention.

The high silicon steel sheet according to the present invention is manufactured either by the siliconizing method or by the rolling method. When the rolling method is applied, however, the upper limit of Si content becomes substantially 7 wt. % from the point of workability.

When the siliconizing method is applied, a steel sheet containing less than 4 wt. % Si is siliconized in the siliconizing zone under a non-oxidization gas atmosphere containing $SiCl_4$, then the heat treatment is applied to diffuse Si into the steel under a non-oxidizing atmosphere containing no $SiCl_4$ to continuously manufacture the high silicon steel sheet. During the manufacturing method, the cooling speed of the steel sheet in the cooling zone is 5° C./sec. or more in a temperature range of from 300 to 700° C.

The precipitation depends on the cooling speed. In this respect, several steel samples having the chemical composition given in Table 3 were rapidly cooled to 700° C. after heating it to 1200° C. for 20 min., followed by cooling them at various cooling speeds to determine the amount of carbide precipitated at grain boundary. The result is shown in FIG. 5.

Figure 5:
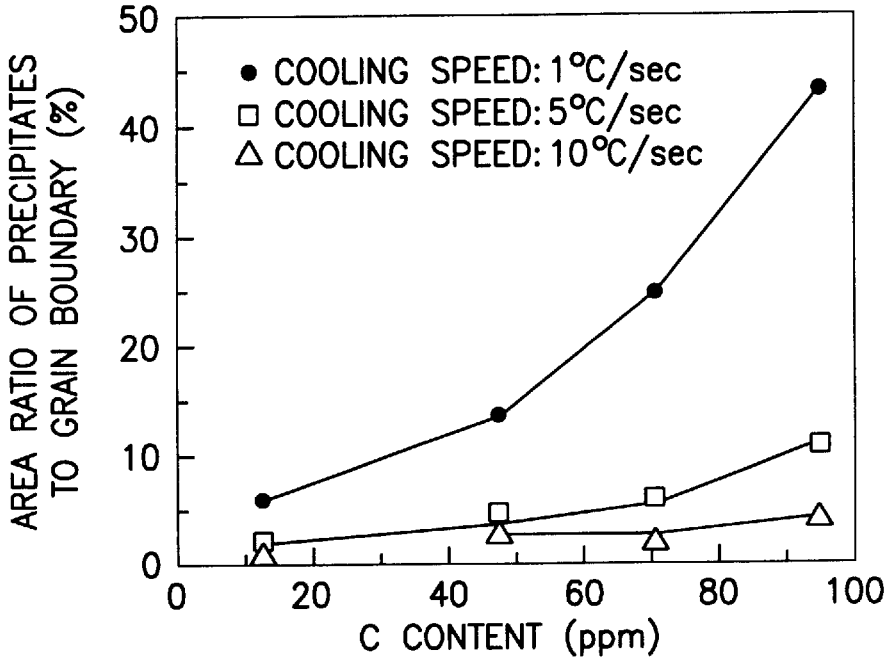
FIG. 5 is a graph showing the relation between the C content of the steel sheet and the area ratio of precipitates to grain boundary for the high silicon steel sheets having 0.3 mm of thickness.

FIG. 5 shows the data obtained from the high silicon steel sheet samples which were prepared by the following procedure.

Steels containing 3 wt. % Si and containing each of four levels of C content were melted, which were then hot-rolled and cold-rolled to 0.3 mm of thickness. Then the siliconizing was conducted on these steels in a conventional continuous siliconizing line to prepare the high silicon steel sheets having 0.3 mm of thickness, containing about 6.5 wt. % Si, and having the composition given in Table 3. Thus prepared steels were annealed in a furnace having a separate atmosphere at 1200° C., and were then rapidly cooled to 700° C., and cooled them to room temperature with three different cooling speeds for respective steel, namely 1° C./sec., 5° C./sec., and 10° C./sec., to prepare the samples. The samples were analyzed to determine the C content which is given on the horizontal axis of FIG. 5. The vertical axis "the ratio of precipitates to grain boundary" was determined in the same procedure as in FIG. 1.

The precipitation state differs depending on the amount of carbon and the cooling speed. However, when the fact that the workability is favorable at 20% or less of the area ratio of precipitates to the total area of grain boundary is taken into account, FIG. 5 identifies that 5° C./sec. or more of cooling speed is favorable. The temperature region in which the cooling speed is specified needs to be between 700° C. where carbide precipitates and 300° C. where carbon becomes substantially difficult to move.

In a manufacturing method using the siliconizing method, generally the lower limit of the cooling speed is about 1° C./sec. Accordingly, when the fact that the workability is favorable at 20% or less area ratio of precipitates to the total area of grain boundary is taken into account, FIG. 5 identifies that the C content of 0.0065 wt. % or less is favorable.

From the above-described discussion, either the method for controlling the cooling speed or the method for controlling the C content can be adopted to suppress the precipitation of carbide. Easier one can be selected under the consideration of cost and so on.

TABLE 3

| (wt %) | | | | | | | |
|---|---|---|---|---|---|---|---|
| C | Si | Mn | P | S | sol.Al | N | O |
| 0.0013 | 6.63 | 0.11 | 0.002 | 0.003 | 0.06 | 0.006 | 0.002 |
| 0.0048 | 6.54 | 0.15 | 0.004 | 0.003 | 0.04 | 0.004 | 0.002 |
| 0.0070 | 6.44 | 0.13 | 0.003 | 0.004 | 0.05 | 0.005 | 0.003 |
| 0.0095 | 6.53 | 0.09 | 0.003 | 0.002 | 0.06 | 0.004 | 0.004 |

When the rolling method is employed, a method for manufacturing a high silicon steel sheet comprises the steps of: hot-rolling a high silicon alloy slab containing 0.01 wt. % or less C and 4 to 7 wt. % Si; descaling the hot-rolled steel sheet; and cold rolling the descaled hot-rolled steel sheet and applying final annealing at 700° C. or more to the cold rolled steel sheet, wherein the cooling speed in the final annealing is 5° C./sec. or more in a temperature range of from 300 to 700° C.

As described above, carbide precipitates at about 700° C. or less, so the final annealing temperature is specified to 700° C. or more, which temperature level should not induce substantially precipitation. The upper limit of the temperature of final annealing step is not necessarily specified. Nevertheless, it is preferred to limit at 1300° C. or less from the economic consideration.

Figure 6:
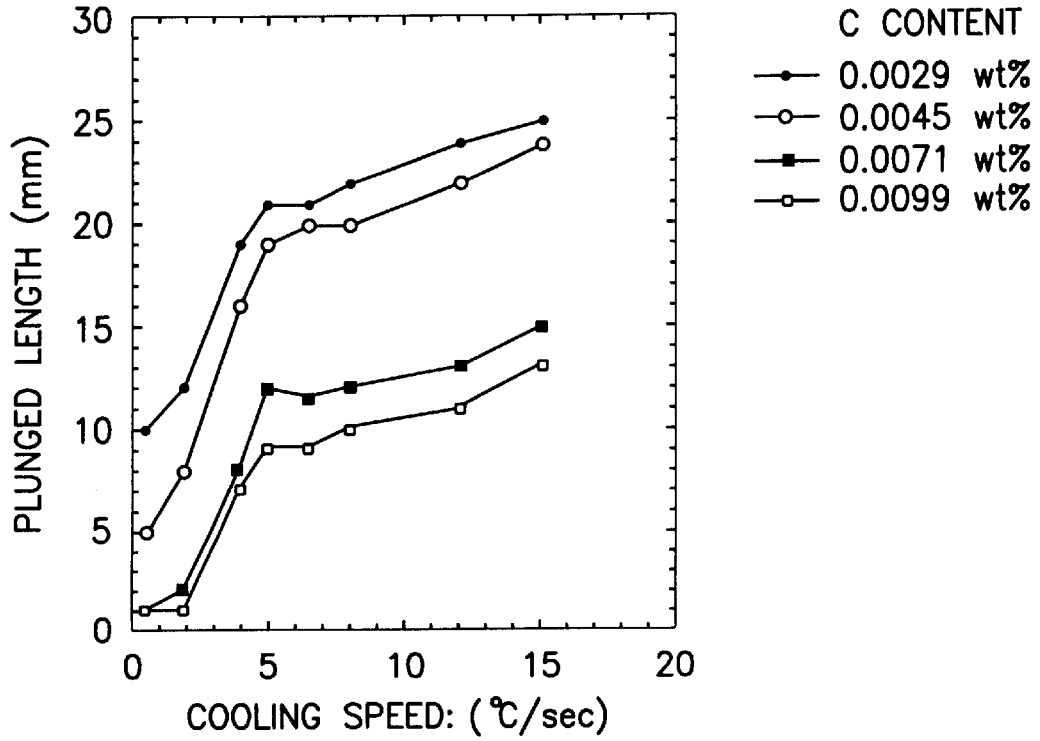
FIG. 6 is a graph showing the relation between the cooling speed and the workability at various levels of C content for the high silicon steel sheets having 0.2 mm of thickness.

Thus, the relation between the workability and the cooling speed was grasped for the case of rolling method. Steels having the composition of Table 4 were melted, and then hot-rolled and cold-rolled to prepare high silicon steel sheets each having 0.2 mm of thickness. These steel sheets were heated to 1200° C. for 15 min., followed by cooling rapidly to 700 C. Then they were tested by a three-point bending testing machine to determine the plunged length. The result is shown in FIG. 6.

Though the workability differs depending on the amount of carbon and the cooling speed, the secondary workability is clearly improved if the cooling speed is 5° C./sec. or more. The reason why the workability differs with cooling speed is presumably that the state of precipitation of carbide at grain boundary differs with cooling speed, which affects the bending workability. The composition given in Table 4 was determined from chemical analysis given after the annealing. The C content should be specified during the cooling step in the final annealing. Consequently, if the C content differs between that in the slab and that in the final product, for example, when the final annealing is conducted in an oxidizing atmosphere or in a carburizing atmosphere, the C content in the final product is necessary to be specified to 0.01 wt. % or less. Also in that case, the temperature region that specifies the above-described cooling speed is necessary between 700° C. which is the upper limit of carbide precipitation and 300° C. where carbon becomes substantially difficult to move.

TABLE 4

| (wt %) | | | | | | | |
|---|---|---|---|---|---|---|---|
| C | Si | Mn | P | S | sol.Al | N | O |
| 0.0029 | 6.44 | 0.13 | 0.001 | 0.002 | 0.05 | 0.006 | 0.002 |
| 0.0045 | 6.49 | 0.10 | 0.003 | 0.003 | 0.04 | 0.004 | 0.004 |
| 0.0071 | 6.51 | 0.12 | 0.001 | 0.003 | 0.05 | 0.004 | 0.003 |
| 0.0099 | 6.48 | 0.09 | 0.002 | 0.002 | 0.06 | 0.004 | 0.002 |

The effect of the present invention is satisfactorily provided for a high silicon steel sheet which contains 0.01 wt. % C and 4 to 10 wt. % Si and which has 20% or less area ratio of carbide at grain boundary against the total area of grain boundary. The effect is further enhanced by using the steel sheet composition further specifying the workability-deteriorating elements: 0.5 wt. % or less Mn, 0.01 wt. % or less P, 0.01 wt. % or less S, 0.2 wt. % of less sol.Al, 0.01 wt. % or less N, and 0.02 wt. % or less O.

The effect of the present invention is obtained independent of the crystal orientation distribution of a high silicon steel sheet, and the present invention is applicable for both oriented high silicon steel sheet and non-oriented high silicon steel sheet.

EXAMPLE

Example 1

Base steel sheets each containing 3.0 wt. % Si and having chemical analysis shown in Table 5 with 0.3 mm of sheet thickness were treated by siliconizing in a conventional continuous siliconizing line to adjust the Si content to a range of from 4 to 10 wt. %. Then these sheets were cooled at various cooling speed respectively to prepare high silicon steel sheets. The products gave about 0.4 mm of crystal grain size, which size did not show difference among various levels of Si content and cooling speed. The chemical analysis after the siliconizing treatment did not show difference among various levels of Si content and cooling speed. The resulted C content was around 80 ppm.

TABLE 5

| (wt %) | | | | | | | |
|---|---|---|---|---|---|---|---|
| C | Si | Mn | P | S | sol.Al | N | O |
| 0.0100 | 2.99 | 0.39 | 0.004 | 0.007 | 0.12 | 0.001 | 0.002 |

Figure 7:
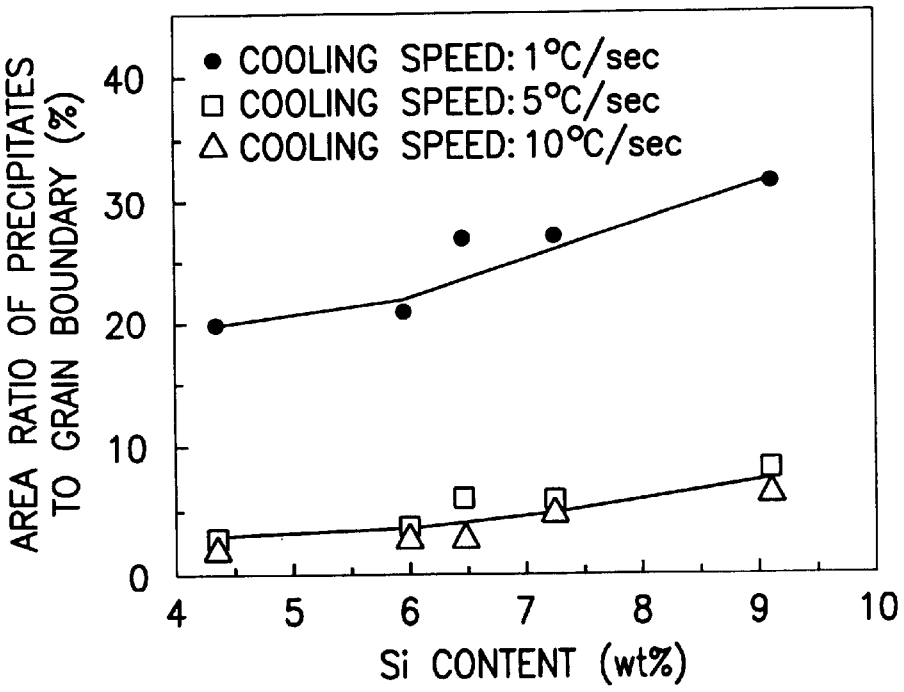
FIG. 7 is a graph showing the relation between the Si content and the area ratio of precipitates to grain boundary for the high silicon steel sheets prepared by the siliconizing method and cooled to room temperature at various levels of cooling speed, namely 1° C./sec., 5° C./sec., and 10° C./sec.

FIG. 7 shows the amount of carbide precipitated at grain boundary of high silicon steel sheets which were prepared by the above-described procedure. FIG. 7 is a graph showing the relation between the Si content in the steel sheet on the horizontal axis and the ratio of precipitates to grain boundary on the vertical axis. The data were acquired for the cases of three levels of cooling to room temperature, namely 1° C./sec., 5° C./sec., and 10° C./sec. The Si content on the horizontal axis of FIG. 7 was determined from the chemical analysis of samples, and the "ratio of precipitates to boundary area" on the vertical axis was determined in a similar manner with that in FIG. 1.

FIG. 7 identified that, for any Si content within a range of from 4 to 10 wt. %, the area ratio of precipitates to the total area of grain boundary becomes 20% or less if only the cooling speed is 5° C./sec. or more.

Example 2

Base steel sheets each containing 3.0 wt. % Si and having chemical analysis shown in Table 6 with 0.3 mm of sheet thickness were treated by siliconizing in a conventional continuous siliconizing line to adjust the Si content to a range of from 4 to 10 wt. %. Then these sheets were cooled at a cooling speed of 2° C./sec. to prepare high silicon steel sheets.

TABLE 6

| (wt %) | | | | | | | |
|---|---|---|---|---|---|---|---|
| C | Si | Mn | P | S | sol.Al | N | O |
| 0.0038 | 3.0 | 0.25 | 0.002 | 0.003 | 0.10 | 0.001 | 0.002 |
| 0.0072 | 3.0 | 0.26 | 0.002 | 0.002 | 0.08 | 0.002 | 0.002 |
| 0.0100 | 3.0 | 0.20 | 0.001 | 0.003 | 0.09 | 0.001 | 0.002 |

The products gave about 0.4 mm of crystal grain size, which size did not show difference among various levels of Si content and cooling speed.

Figure 8:
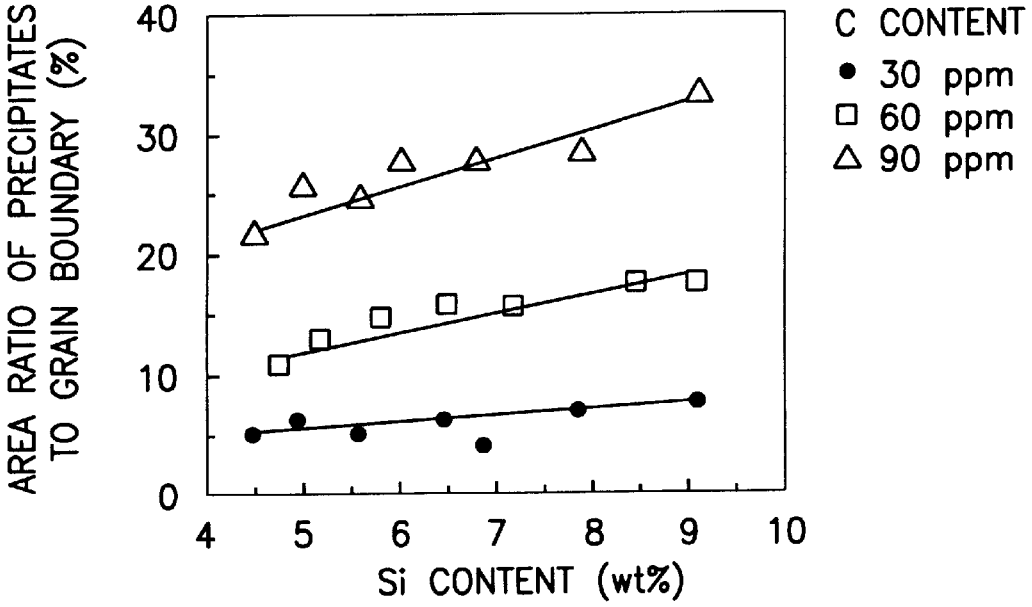
FIG. 8 is a graph showing the relation between the Si content and the area ratio of precipitates to grain boundary for the high silicon steel sheets cooled at a speed of 2° C./sec. with three different levels of C content, 30 ppm, 65 ppm, and 90 ppm.

FIG. 8 shows the amount of carbide precipitated at grain boundary of high silicon steel sheets which were prepared by the above-described procedure. FIG. 8 is a graph showing the relation between the Si content in the steel sheet on the horizontal axis and the ratio of precipitates to grain boundary on the vertical axis. The data were acquired for the cases of three levels of C content, namely 30 ppm, 65 ppm, and 90 ppm. The Si content and C content in FIG. 8 were determined from the chemical analysis of samples, and the "rate of precipitates to boundary area" was determined in a similar manner with that in FIG. 1.

FIG. 8 identified that, for any Si content within a range of from 4 to 10 wt. %, the area ratio of precipitates to the total area of grain boundary becomes 20% or less if only the C content is 65 ppm or less (or 0.0065 wt. % or less).

Example 3

Figure 9:
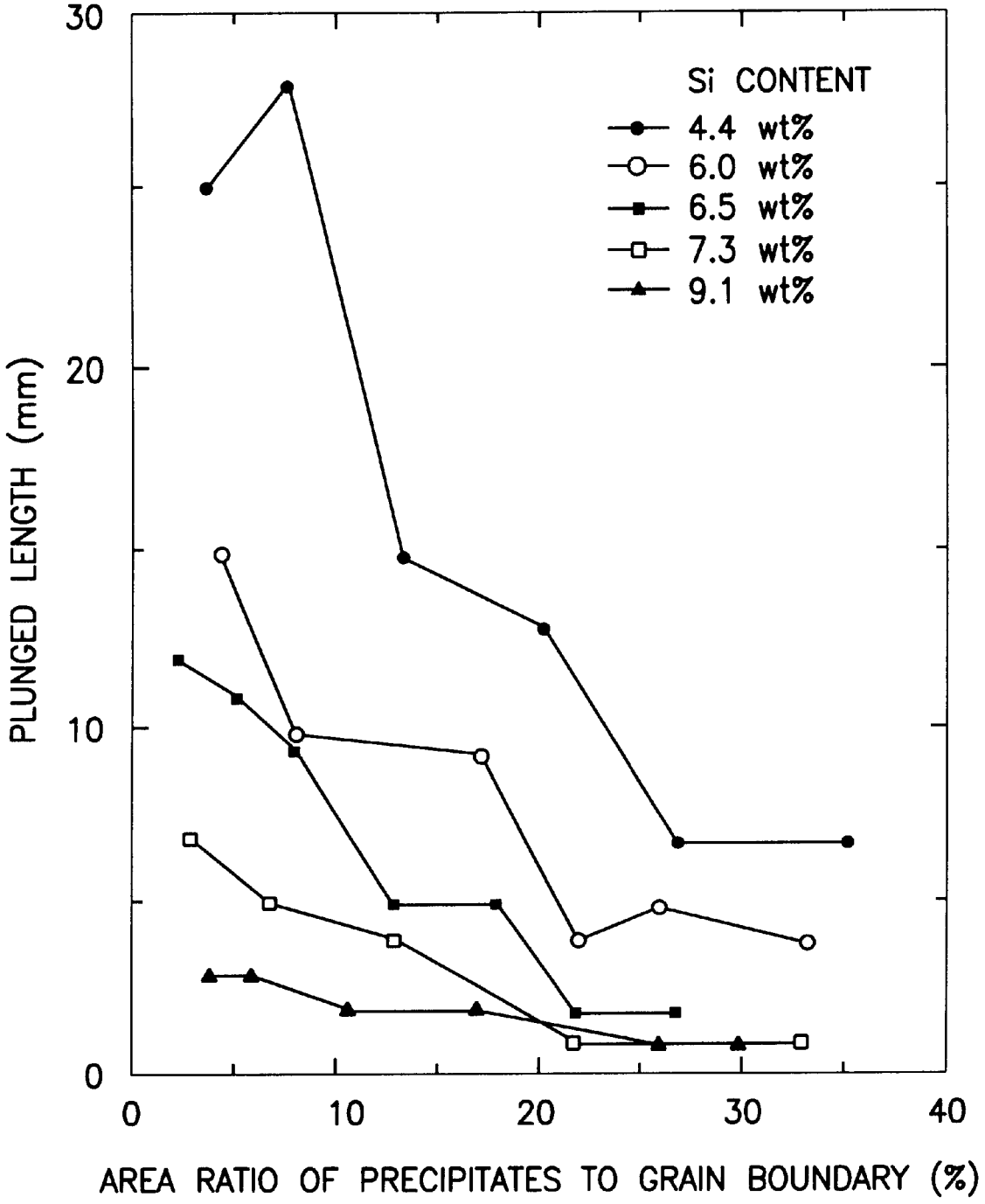
FIG. 9 is a graph showing the relation between the area ratio of precipitates to grain boundary and the plunged length determined in the three-point bending test for the high silicon steel sheets prepared by the siliconizing method with various levels of Si content.

The samples having various levels of S content prepared in Example 1 were heated to 1200° C. for 20 min., and rapidly cooled to 700° C., then they were cooled at various speeds, separately, to precipitate carbide on grain boundary. These samples were tested by a three-point bending testing machine to determine the relation between the plunged length and the amount of carbide at grain boundary. The result is shown in FIG. 9. FIG. 9 is a graph showing the relation between the area ratio of precipitates at grain boundary to the total area of grain boundary on the horizontal axis and the plunged length determined in the three-point bending test on the vertical axis. The area ratio of precipitates at grain boundary to the total area of grain boundary was determined by the same procedure that in FIG. 1. The plunged length in the three-point bending testing machine was determined by the same procedure as in FIG. 1 using the device shown in FIG. 2.

Workability differs with Si content. Increase in Si content deteriorates the workability, so the determination of workability should be given in every Si content level. When FIG. 9 is referred taking into account of the effect of Si content, for all the Si contents given in the figure, it is confirmed that the reduction of the amount of carbide at grain boundary improves the workability and that the workability is favorable if the area ratio of precipitates at grain boundary is 20% or less to the total area of grain boundary.

Example 4

Slabs having chemical analysis of Table 7 were hot-rolled. The hot-rolled sheets were descaled, and rolled to 0.2 mm of sheet thickness, which were then subjected to final annealing in nitrogen atmosphere at 1200° C., for 15 min. During the final annealing, the sheets were cooled by several cooling speed levels, separately, to prepare high silicon steel sheets. The crystal grain size was about 0.3 mm for all the prepared products giving no difference against the change in Si content and cooling speed. The composition shown in Table 7 was obtained by chemical analysis after the final annealing.

TABLE 7

| (wt %) | | | | | | | |
|---|---|---|---|---|---|---|---|
| C | Si | Mn | P | S | sol.Al | N | O |
| 0.0075 | 4.53 | 0.26 | 0.006 | 0.006 | 0.11 | 0.001 | 0.002 |
| 0.0078 | 5.57 | 0.34 | 0.004 | 0.006 | 0.10 | 0.002 | 0.002 |
| 0.0080 | 6.52 | 0.39 | 0.004 | 0.007 | 0.12 | 0.001 | 0.002 |

Figure 10:
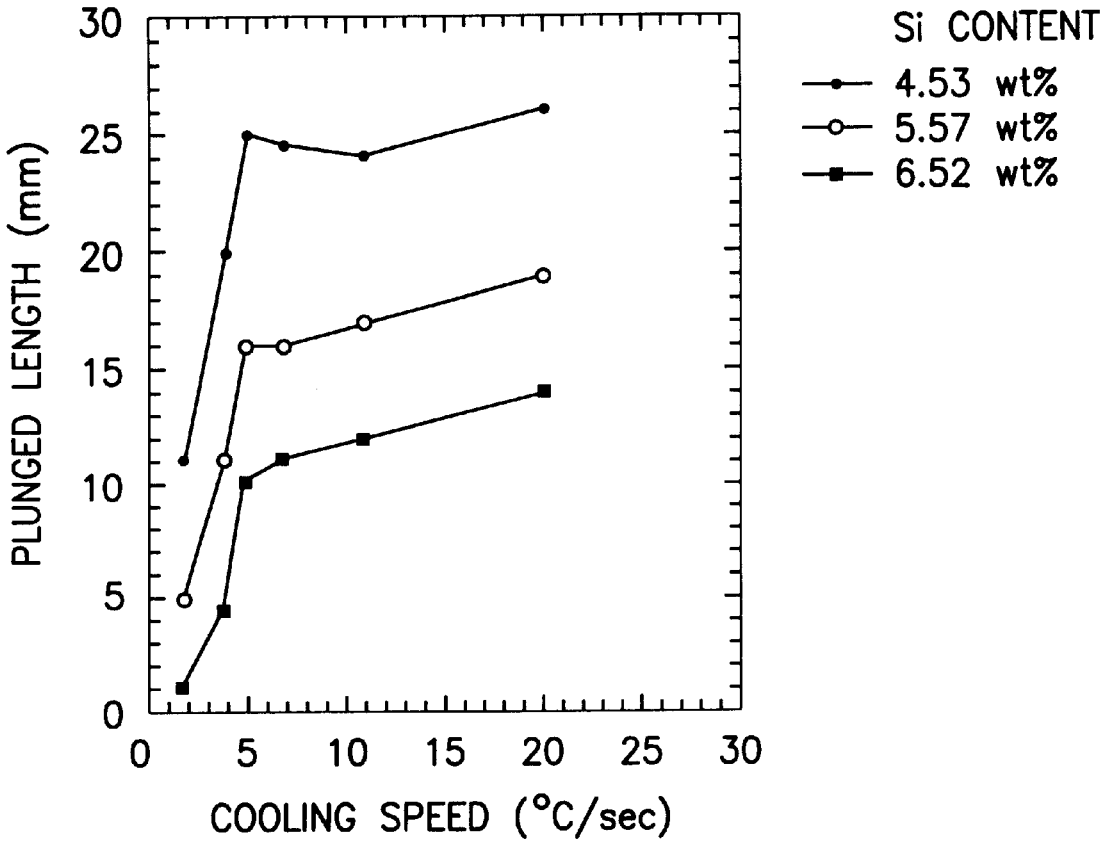
FIG. 10 is a graph showing the relation between the cooling speed and the workability for the high silicon steel sheets prepared by the rolling method with various levels of Si content.

FIG. 10 shows the relation between the cooling speed and the workability of thus prepared high silicon steel sheets. The workability was evaluated by a three-point bending test using the tester shown in FIG. 4. The absolute value of workability is significantly affected by the Si content. However, it was confirmed that high silicon steel sheets having favorable workability are obtained if only the cooling speed is 5° C./sec. or more for any Si content level. The presumable reason why the workability varies with cooling speed is that the state of precipitation of carbide at grain boundary changes with cooling speed, which then affects the bending workability.

As described above, the present invention provides a high silicon steel sheet having excellent workability and provides a method for manufacturing thereof. With the use of the steel sheet, the present invention provides the product with excellent secondary workability, thus offering useful effect on industrial applications.

What is claimed is:

1. A silicon steel sheet consisting essentially of:

C in an amount of 0.01 wt. % or less, Si in an amount of 4 to 10 wt. %, Mn in an amount of 0.5 wt. % or less, P in an amount of 0.01 wt. % or less, S in an amount of 0.01 wt. % or less, sol. Al in an amount of 0.2 wt. % or less, N in an amount of 0.01 wt. % or less, O in an amount of 0.02 wt. % or less and the balance being Fe;

said silicon steel sheet having grain boundaries and carbides which are precipitated on the grain boundaries;

said carbides having an area of 20% or less of the total area of the grain boundaries.

2. The silicon steel sheet of claim 1, wherein said carbides includes carbides of Fe and carbides of Fe and Si.

3. The silicon steel sheet of claim 1, wherein said area of the carbides is 10% or less of the total area of the grain boundaries.

4. The silicon steel sheet of claim 1, wherein the Si content is 4.53 to 10 wt. %.

5. The silicon steel sheet of claim 4, wherein the Si content is 5.57 to 10 wt. %.

6. The silicon steel sheet of claim 5, wherein the Si content is 5.57 to 7 wt. %.

7. The silicon steel sheet of claim 4, produced by the method comprising the steps of:

preparing a steel sheet containing Si in an amount of less than 4 wt. %;

siliconizing the steel sheet in a non-oxidizing gas atmosphere containing $SiCl_4$;

heat treating the siliconized steel sheet in a non-oxidizing gas atmosphere containing no $SiCl_4$ to diffuse Si into the internal portion of the steel sheet; and cooling the heat treated steel sheet at a cooling speed of 5° C./sec. or more in a temperature range of from 300 to 700° C.

8. The silicon steel sheet of claim 7, wherein the Si content is 5.57 to 10 wt. %.

9. The silicon steel sheet of claim 8, wherein the Si content is 5.57 to 7 wt. %.

10. The silicon steel sheet of claim 9, wherein said carbides includes carbides of Fe and carbides of Fe and Si.

11. The silicon steel sheet of claim 9, wherein said area of the carbides is 10% or less to the area of the grain boundaires.

* * * * *